US007284562B2

(12) United States Patent
Hardee et al.

(10) Patent No.: US 7,284,562 B2
(45) Date of Patent: Oct. 23, 2007

(54) TARPAULIN OR CANOPY CORNER CONSTRUCTION

(75) Inventors: Howard A. Hardee, Wichita, KS (US); Suk Keun Yoo, Incheon (KR)

(73) Assignee: The Coleman Company, Inc., Wichita, KS (US)

( * ) Notice: Subject to any disclaimer, the term of this patent is extended or adjusted under 35 U.S.C. 154(b) by 47 days.

(21) Appl. No.: 11/272,979

(22) Filed: Nov. 14, 2005

(65) Prior Publication Data

US 2006/0075947 A1 Apr. 13, 2006

Related U.S. Application Data

(63) Continuation of application No. 09/998,603, filed on Nov. 16, 2001.

(51) Int. Cl.
*E04H 15/56* (2006.01)

(52) U.S. Cl. ..... 135/116; 135/115

(58) Field of Classification Search ..... 135/115, 135/116, 118, 119, 120.3, 120.4; 442/263; 2/89

See application file for complete search history.

(56) References Cited

U.S. PATENT DOCUMENTS

| | | | |
|---|---|---|---|
| 2,114,061 | A | 4/1938 | Robinson |
| 2,569,627 | A | 10/1951 | Black |
| 2,808,844 | A | 10/1957 | Powers |
| 3,056,415 | A | 10/1962 | Nimmo |
| 3,111,688 | A | 11/1963 | Barnes |
| 3,586,013 | A | 6/1971 | Gladden et al. |
| 3,646,624 | A | 3/1972 | Zipf, III |
| 3,699,986 | A | 10/1972 | Kirkham |
| 3,896,830 | A | 7/1975 | Sharick |
| 4,015,297 | A | 4/1977 | Christian |
| 4,063,566 | A | 12/1977 | Millerioux |
| 4,064,662 | A | 12/1977 | O'Toole |
| 4,077,417 | A | 3/1978 | Beavers |
| 4,116,148 | A | 9/1978 | Torrez |
| 4,133,149 | A | 1/1979 | Angress |
| 4,165,757 | A | 8/1979 | Marks |
| 4,241,745 | A | 12/1980 | Knox |
| 4,265,261 | A | 5/1981 | Barker |
| 4,279,045 | A | 7/1981 | Vitale |
| 4,305,414 | A | 12/1981 | Bareis |

(Continued)

OTHER PUBLICATIONS

Holub, Timothy M., "Declaration of Timothy M. Holub," The Coleman Company, Inc., 2pgs (2005).

*Primary Examiner*—David Dunn
*Assistant Examiner*—Noah Chandler Hawk
(74) *Attorney, Agent, or Firm*—Leydig, Voit & Mayer, Ltd.

(57) ABSTRACT

A method of constructing a water-resistant corner for a tent or other fabric structure, and the corner formed therefrom. A protective panel may be laid over a flooring material sheet, and the sheet and the protective panel are folded into a corner. The formed corner may then be turned inside out, so that the protective panel is located on the outside of the newly-formed corner. The protective panel thereby covers the outermost corner of the flooring, and the seam formed at that corner. An interior waterproof layer, such as a waterproof sealing tape, may be attached on the inside of the inverted corner to act as a further moisture barrier.

20 Claims, 5 Drawing Sheets

U.S. PATENT DOCUMENTS 4,461,049 A 7/1984 Hammond
4,519,410 A 5/1985 Kubacki
5,083,644 A 1/1992 Collins, III
5,197,504 A 3/1993 Howe
5,279,237 A 1/1994 Alivizatos
5,283,112 A * 2/1994 Krishnan ..... 442/263
5,301,705 A 4/1994 Zheng
5,313,972 A 5/1994 Goldberg
5,328,268 A 7/1994 Lafleur
5,411,425 A * 5/1995 Rinker ..... 441/130
5,582,197 A 12/1996 Dobberstein
5,771,912 A 6/1998 Swetish
6,068,009 A 5/2000 Paes et al.
6,122,782 A 9/2000 Chedid
6,154,884 A 12/2000 Dehner
2003/0127123 A1* 7/2003 Choi ..... 135/115
2005/0172990 A1* 8/2005 Choi ..... 135/119

* cited by examiner

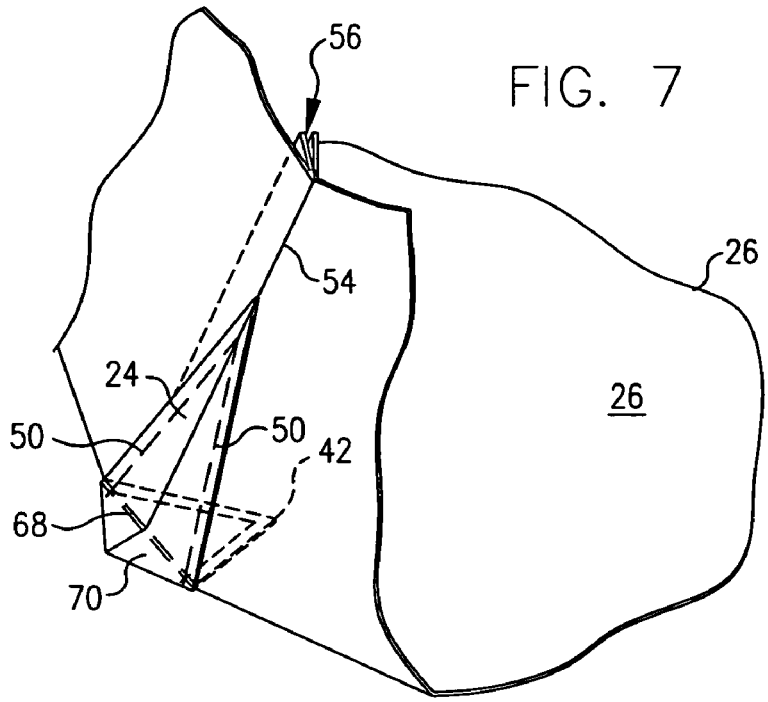
FIG. 7
FIG. 8
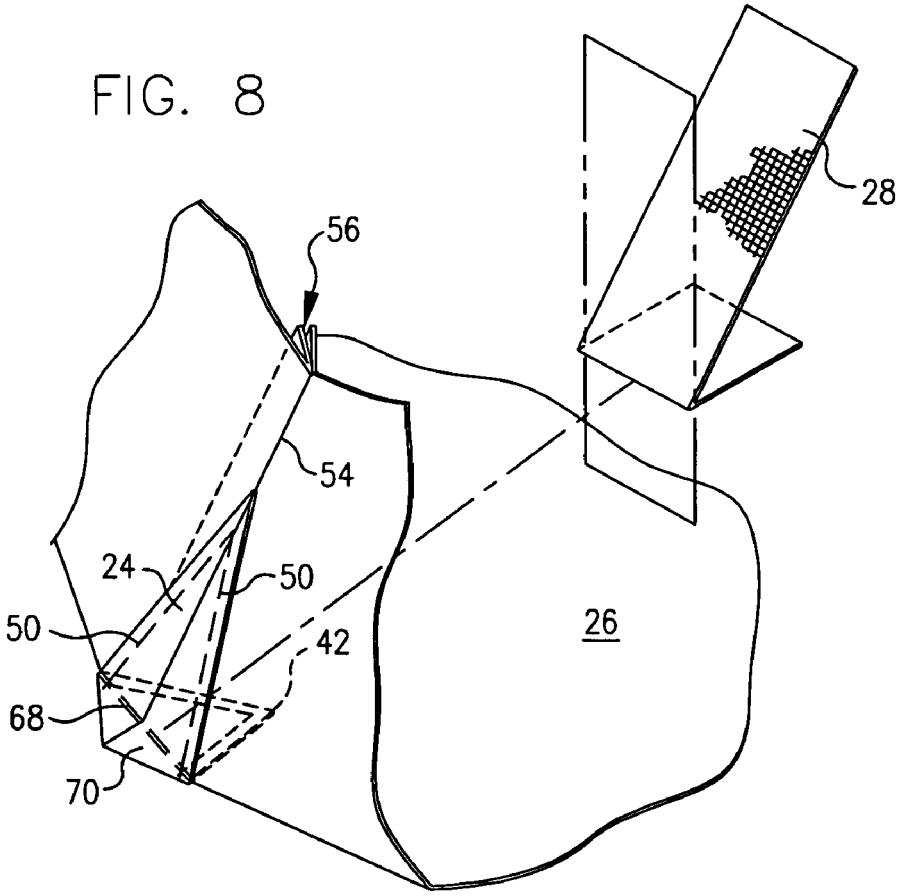

TARPAULIN OR CANOPY CORNER CONSTRUCTION

REFERENCE TO RELATED APPLICATION

This application is a continuation application of U.S. patent application Ser. No. 09/998,603, filed Nov. 16, 2001, and incorporated herein by reference.

FIELD OF THE INVENTION

The present invention relates generally to tents, and more particularly to tent construction.

BACKGROUND OF THE INVENTION

Tents are portable shelters made of lightweight, often waterproof fabrics. Tents come in a variety of shapes and sizes. The most popular shape is the dome, or freestanding model. This model is easy to set up and does not require support from tree limbs or other objects.

The upper portion of most tents is often formed of a weather-resistant material, such as canvas or nylon. The bottom of the tent is often formed from nylon or polyethylene with a permanent waterproof coating (often made of urethane). Each of these materials works well to repel water, but the flooring material is typically more waterproof. In one present day design, the floor material wraps up the lower walls of the tent, forming a "tub" of the flooring material. By wrapping the material partly up the side of the tent, the lower parts of the tent, which are more prone to be in prolonged contact with water, are provided an enhanced water barrier.

Although present tent materials work well for their intended purpose, one problem associated with some present tent designs is the seams for the tents can leak, thus requiring seal-coating or coverage by rain tarps. This problem is particularly true for floor seams, which tend to have prolonged contact with water. A tent floor having a tub design avoids this problem to some extent, because the seams adjoining the side walls with the floor are removed from the ground. However, the corners of the floor tub are joined at seams, and these seams can also leak. A leaky seam can cause water to enter a tent, making a stay in a tent miserable.

SUMMARY OF THE INVENTION

The present invention provides a method of constructing a corner for a tent or other fabric covering that solves many of the prior art problems of seam leakage at the corners. The invention has particular application to floor corner seams for tents having tub floors.

In accordance with one aspect of the present invention, a notch is formed in a flooring material sheet, and a protective panel is laid over the flooring material sheet, adjacent the notch. The protective panel is cut to match the sides of the notch.

The sides of the notch are folded inward against one another to form a corner. At this point, the protective panel is located on the inside of the formed corner. The sides of the notch and the protective cover are then connected, such as by stitching or heat welding.

In accordance with a further aspect of the present invention, the formed corner is turned inside out, so that the protective panel is located on the outside of the newly-formed corner. The protective panel thereby covers the outermost corner of the flooring, and the seam formed at that corner. The excess material from the seam attachment (e.g., the overlap material beyond a stitched attachment) may be located on the inside of the corner, giving the corner a smooth outer appearance. The protective panel provides strength for the corner attachment.

In accordance with another aspect of the present invention, the protective panel and the flooring material sheet are pinched together to form a tab. The pinched material may be attached to one another, for example by welding or stitching. A grommet, a loop, or other attachment structures may be attached to the tab. The pinched-together fabric steps the angle of transition between adjacent sides, causing the interior and exterior of the corner to have a smooth, rounded appearance.

In accordance with yet another aspect of the invention, a sealing tape, such as a waterproof tape, is attached on the inside of the inverted corner. The sealing tape preferably overlaps the seam formed by the connection of the two sides of the notch. If there is excess material present at the seam, it may be folded over and trapped under the sealing tape. The sealing tape may be attached to the flooring material sheet by welding or another adhesion process.

If a polyethylene fabric is used, then the sealing tape may also be polyethylene. The polyethylene tape is then sealed to the polyethylene fabric, for example by heat welding. This structure provides a relatively inexpensive corner that may be used for a tent.

The process for forming the corner in accordance with the present invention results in a sturdy, sealed corner construction that may be used for tents, tarpaulins, and other fabric structures. The improved corner provides a sturdy location for the attachment of cords, stakes, or poles (i.e., the tab), and seals the corner to protect the inside of the structure from inclement weather, such as rain or wind.

Other advantages will become apparent from the following detailed description when taken in conjunction with the drawings, in which:

BRIEF DESCRIPTION OF THE DRAWINGS

FIG. 7 is a partial cutaway view, similar to FIG. 6, showing a further stage of assembly of the corner of FIG. 2, in which the outermost portion of the inside-out corner has been flattened to form a tab;

FIG. 8 is a partial cutaway view, similar to FIG. 7, showing a still further stage of assembly of the corner of FIG. 2, showing a sealing tape spaced from an interior portion of the corner;

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. In addition, to the extent directional references are used, such as top, bottom, forward, rearward, or the like, the references are for ease of illustration, and a person of skill in the art may reorient the elements of the invention as necessary. Furthermore, well-known features may be omitted or simplified in order not to obscure the present invention.

Figure 1:
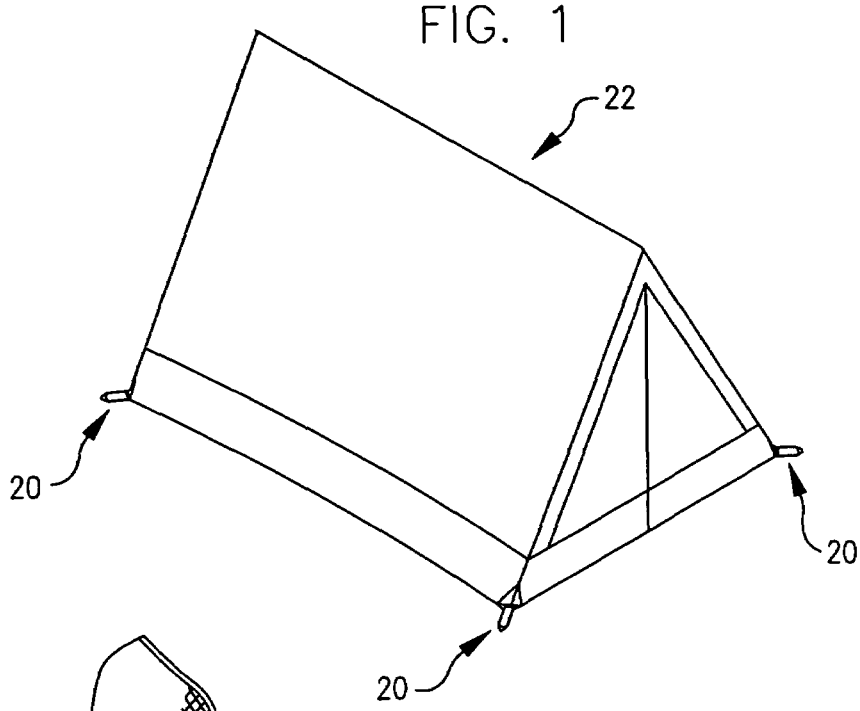
FIG. 1 is a perspective view of a simplified design of a tent incorporating the present invention.
Figure 2:
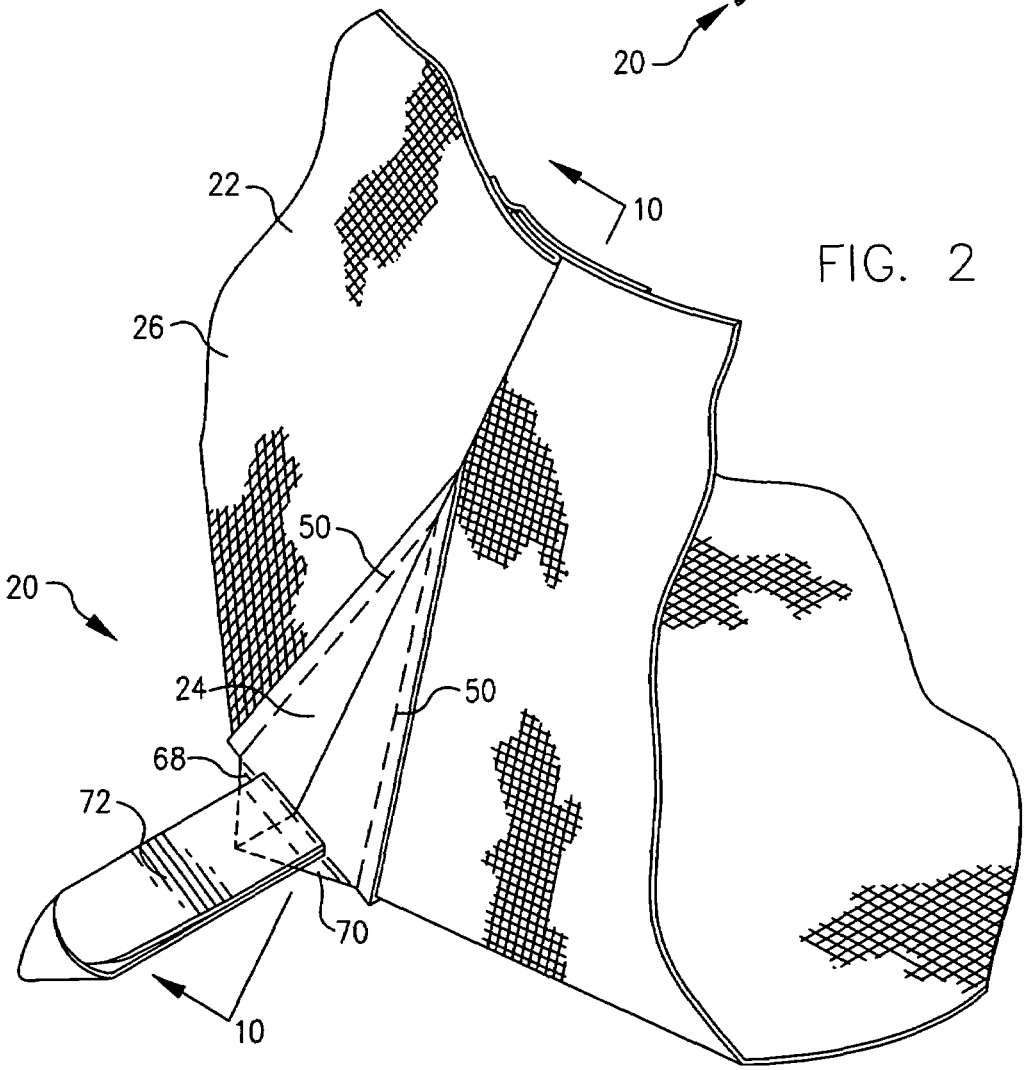
FIG. 2 is a partial cutaway view of one corner of the tent of FIG. 1.
Figure 3:
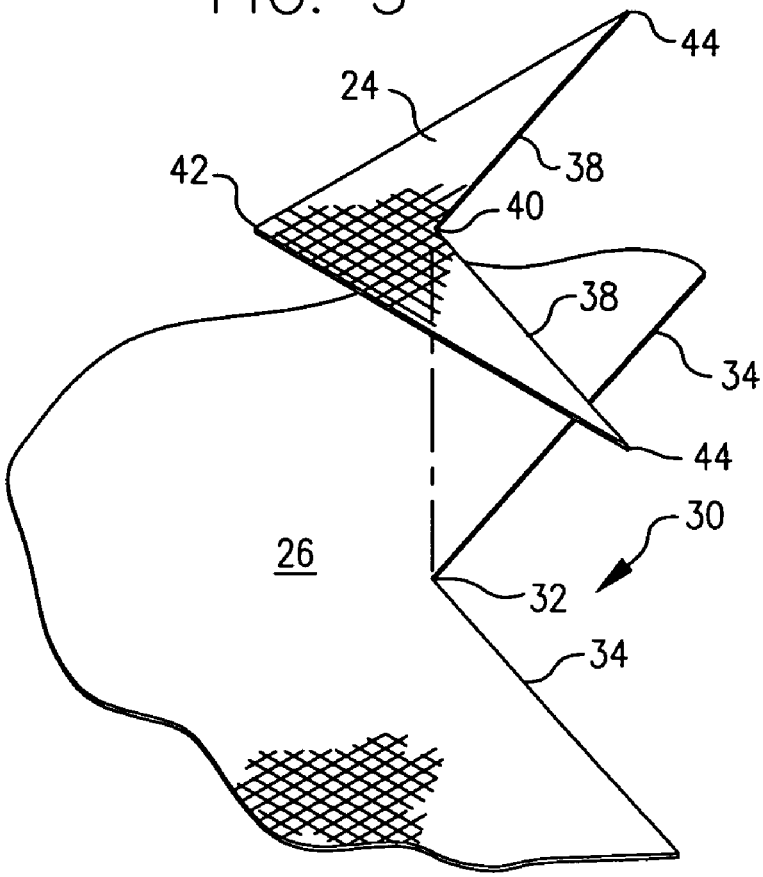
FIG. 3 is a partial cutaway view showing a beginning stage of assembly of the corner in FIG. 2, showing a protective panel being attached to a section of floor sheet.

Briefly described, with reference to FIGS. 1 and 2, the present invention is directed to a construction of an improved, sealed corner 20 for a tent 22. Briefly described, the corner 20 is formed by attaching a protective panel 24 (FIG. 3) over a corner of a sheet 26 for forming the corner, attaching the sides of the sheet 26 to form seams, and turning the seams inside out. In addition, in accordance with another aspect of the present invention, a sealant tape 28 (FIG. 8) is added to the interior of the inside-out corner construction.

Although described with reference to a corner 20 of a tent 22, the teachings of the present invention may be used to form a corner for any fabric structure, including, but not limited to, tarpaulins and canopies. In addition, although the corners 22 shown for the tent are at approximately 90 degrees, the tent corner construction of the present invention may be used for any turn in the fabric, including angles that are less than or equal to 90 degrees. The present invention has particular application, however, to corners for tub structures in which waterproof characteristics are desirable.

Using the process of the present invention, a tent floor may be formed having a tub structure, i.e., the material for the floor partly wraps up the sides of a tent, such as is shown in FIG. 1. In this manner, the tent floor provides maximum protection from a wet ground.

The sheet 26 is preferably formed from a waterproof, flexible, material, such as taffeta nylon with a permanent waterproof coating (often made of urethane). Other materials may be used. For example, as described below, the sheet may be formed of polyethylene, such as low density polyethylene (LDPE).

A notch 30 (FIG. 3) is cut in the sheet 26 at the location where the corner 20 will be formed. The notch 30 includes an apex 32 and side edges 34. The notch 30 is preferably shaped so that its side edges 34 may be folded adjacent to one another, forming the three-dimensional corner and providing a desired angle of transition between the side edges of the floor of the corner 20, such as a 90 degree turn in the sheet 26. In addition, the notch 30 is preferably formed so the resultant corner 30 has a desired pitch for each of the sides of the tent 22. A person of ordinary skill in the art can prepare the notch 30 in accordance with a desired tent (or other structure) configuration.

The protective panel 24 may also be formed from a waterproof, flexible material, such as polyethylene or taffeta nylon with a permanent waterproof coating (e.g., urethane). An inside edge 38 of the protective panel 24 is cut to match the contour of the notch 30 at the apex 32 and up the adjacent side edges 34. The protective panel 24 preferably includes additional fabric adjacent to an apex 40 of the inside edge 38. In the embodiment shown, the additional fabric extends outward to a point 42. The remainder of the additional fabric in the shown embodiment tapers to points 44 at the inside edge 38. Thus, the overall shape of the protective panel 24 shown in the drawings is much like a boomerang, with front and rear edges being triangles, the distal ends connected, and the apexes of the triangles being separated.

Figure 4:
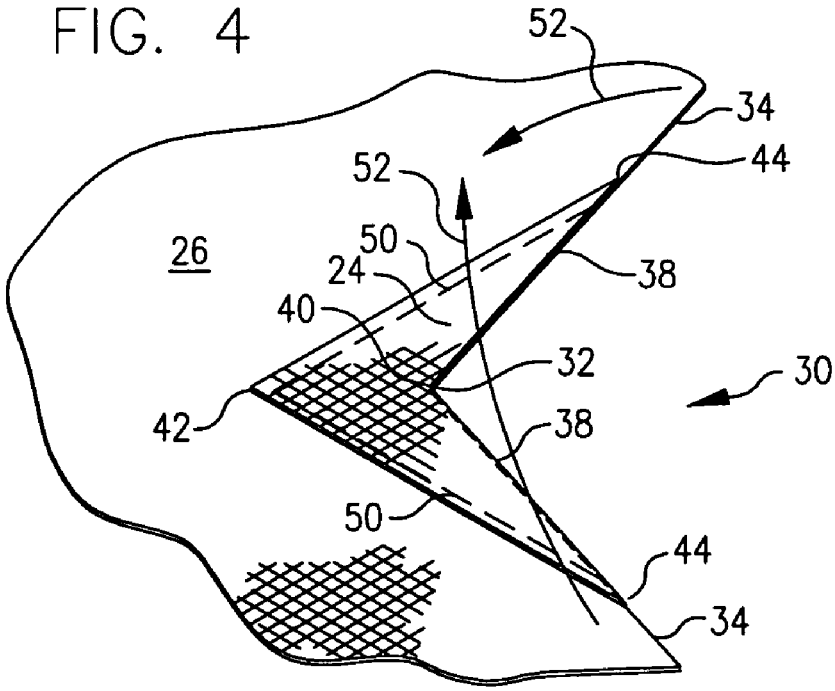
FIG. 4 is a partial cutaway view, similar to FIG. 3, showing a further stage of assembly of the corner of FIG. 2, in which the protective panel is attached to the floor sheet.

Exemplary methods that may be used in construction of the corner 20 are shown in FIGS. 3-9. Beginning at FIG. 3, the protective panel 24 is aligned over the sheet 26 so that the inside edge 38 is aligned with the notch 30. The protective panel 24 is then attached to the sheet 26, for example by welding or stitching the outer edges of the protective panel to the sheet (attachment is shown in FIG. 4 along a stitch line 50).

Figure 5:
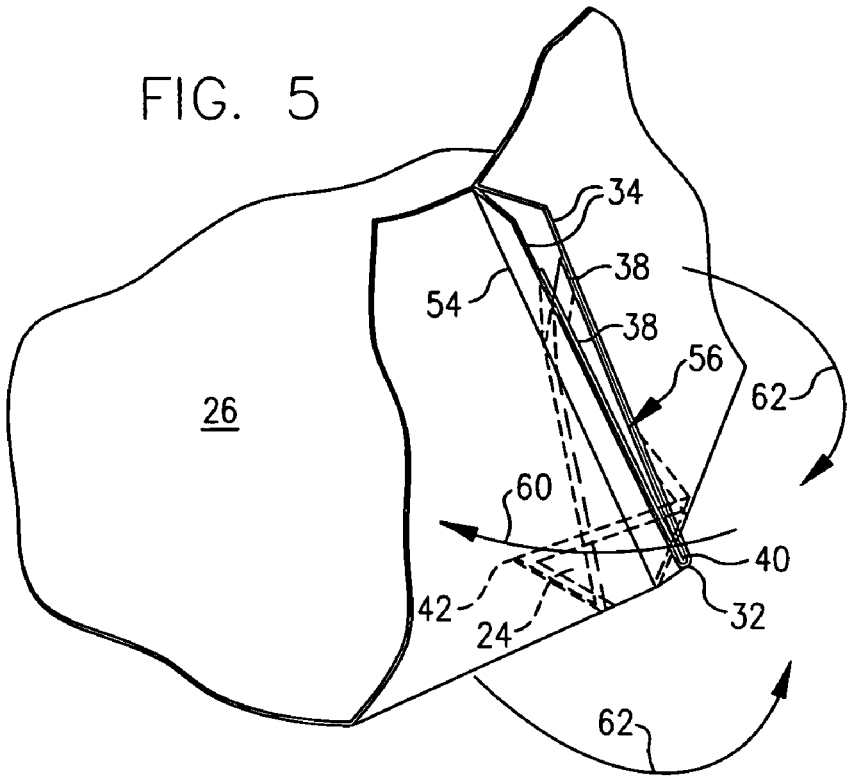
FIG. 5 is a partial cutaway view, similar to FIG. 4, showing a still further stage of assembly of the corner of FIG. 2, in which the floor sheet is folded to form a corner.

After the protective panel 24 is attached to the sheet 26, the side edges 34 of the notch 30 are folded upward and inward from the position shown in FIG. 4 to the position shown in FIG. 5, as indicated by the arrows 52 in FIG. 4. In this manner, a three-dimensional corner is formed. The three-dimensional corner is beneficial in that it permits a sheet of material to wrap around adjacent edges of at least three sides of a tent or other fabric structure. Thus, the three-dimensional corner may be used for the corners of a tub floor bottom for a tent, for example. The opposite side edges 34 are then attached, such as by heat welding, stitching, or in another suitable manner. In the embodiment shown, a flap 56 of material from each of these pieces extends outward and is stitched or otherwise attached together on the inside of the corner. A seam 54 is formed where the opposite materials meet. The flap 56 of material includes the side edges 34 of the notch 30 and the inside edge 38 of the protective panel 24. With the exception of the material that is a part of the flap 56, the protective panel 24 extends on the inside portion of the corner that is formed in FIG. 5.

Figure 6:
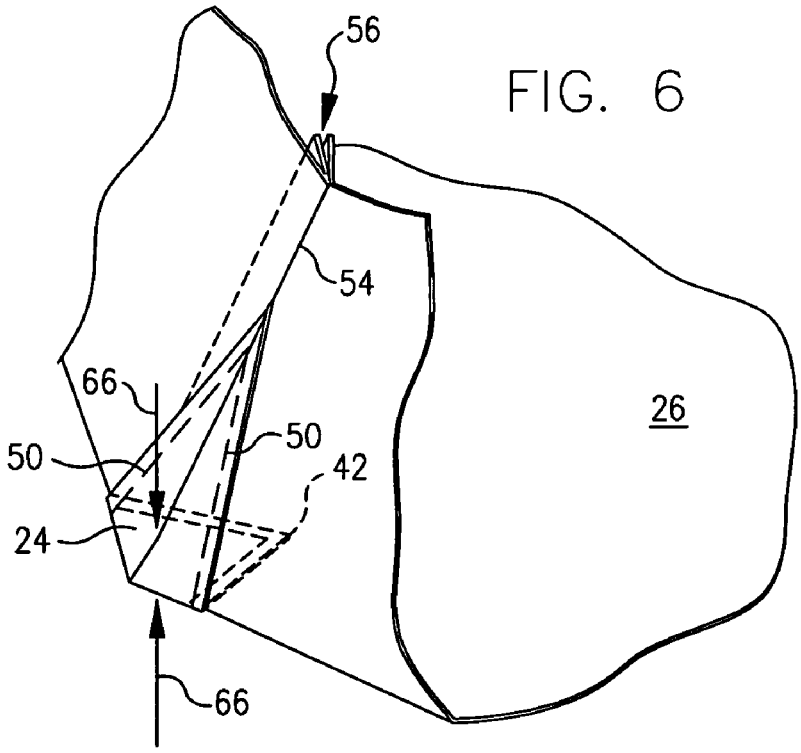
FIG. 6 is a partial cutaway view, similar to FIG. 5, showing an even further stage of assembly of the corner of FIG. 2, in which the corner is turned inside out.

In accordance with one aspect of the present invention, the corner is then turned inside out. To do this, the flap 56 and the corner are pushed inward, as shown by the arrow 60 in FIG. 5, and the adjacent portions of the sheet 26 are rolled about (arrows 62 in FIG. 5), causing the protective panel 24 to be pushed to the outside of the corner, as shown in FIG. 6. The flap 56 is thus moved to the inside of the corner, exposing the seam 54 along the outer edge of the corner. The extra material for the protective panel 24 extends underneath the corner, as shown in FIG. 6.

Turning the corner inside out causes the stitching for the seam 54, which is located on the flap 56, to be located on the inside of the inverted corner. This feature is advantageous because stitching is often a source of water leakage in a seam.

After the corner is turned inside out, the material at the apex of the corner extends outward a little, in a sort of a wrinkle. This material may be pinched together, as shown by the arrows 66 in FIG. 6. The pinched-together material may then be connected, such as by heat welding, stitching, or another suitable attachment. In FIG. 7, the pinched-together fabric is shown held together by a stitch line 68. The pinched, connected portion of the pinched-together fabric, which in this case includes both the protective panel 24 and the sheet 26, forms a tab 70 at the apex of the corner 20. By gathering the loose material at the apex, the tab 70 also smoothes the corner 20, both by rounding its edge and by straightening the sides adjacent to the corner. In addition, the tab 70 provides a location to which a grommet, a rope, a loop, or another structure may be attached.

Figure 9:
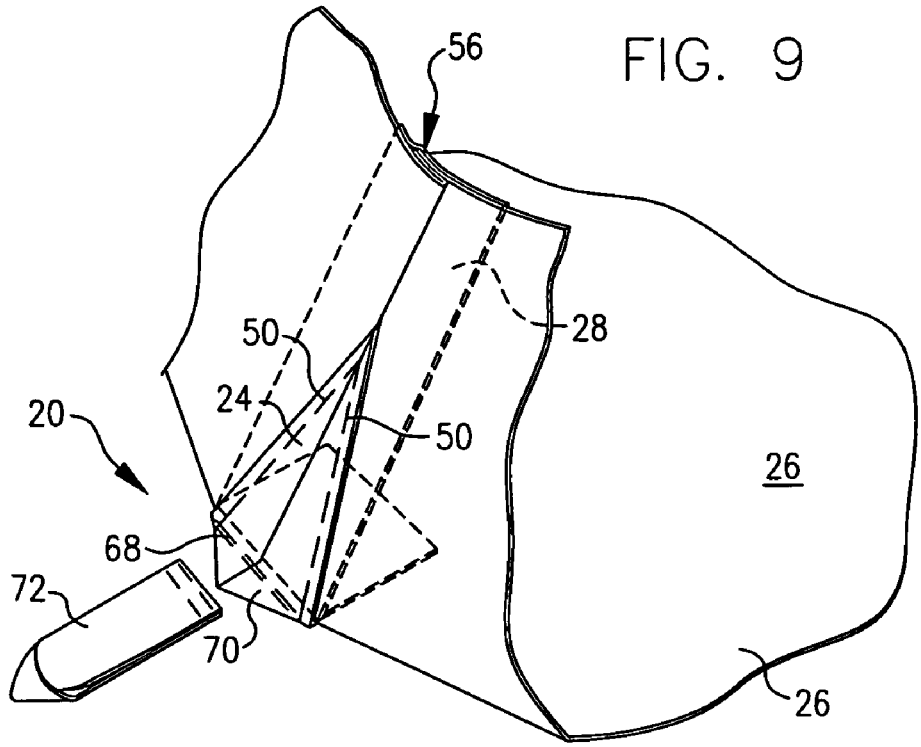
FIG. 9 is a partial cutaway view, similar to FIG. 8, showing an even further stage of assembly of the corner of FIG. 2, in which the sealing tape is attached to the interior portion of the corner.
Figure 10:
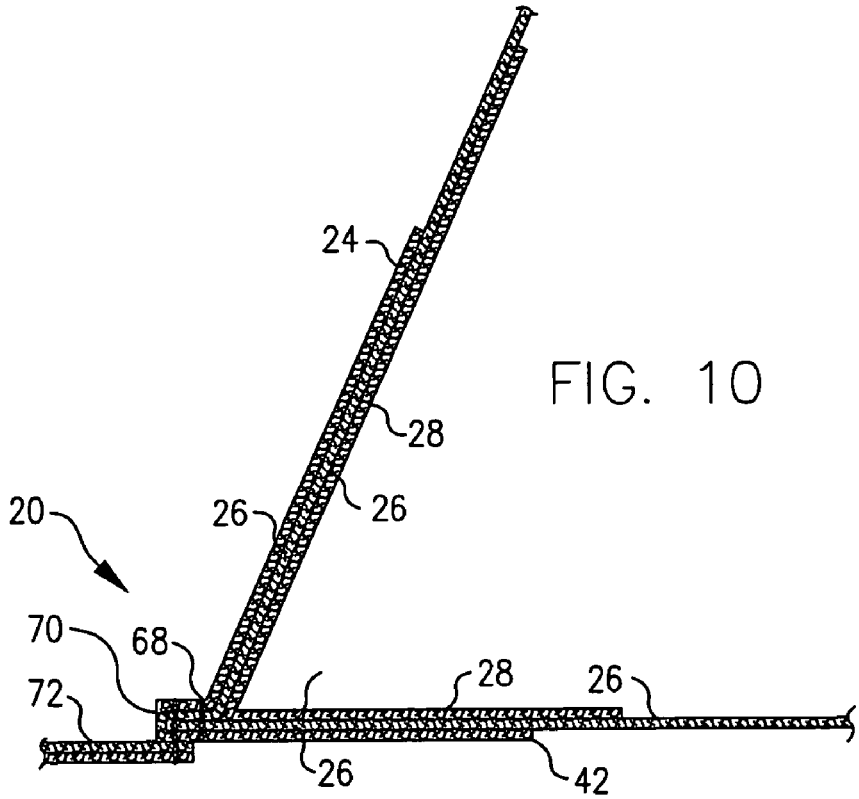
FIG. 10 is a sectional view taken along the section lines 10-10 of FIG. 2.

In FIGS. 2 and 9, a loop 72 is shown attached to the tab 70. The loop 72 may serve many purposes. For example, a stake may extend though the loop 72 and into the ground, thereby securing the tent 22. In addition, a tie line or tie lines may be attached to the loop 72, or a pole for a tent may be attached to, or extend through, the loop.

The tab's connection to both the protective panel 24 and the sheet 26 creates a secure connection for the tab 70. In addition, because the tab 70 is separated from the interior of the corner by the seam 54 and at least two layers of material (i.e., the sheet 26 and protective panel 24) are between the tab and the interior, the tab 70 does not create a leakage problem for the inside of the corner 20.

The protective panel 24 provides extra strength at the seam 54 of the corner 20. Its extra material overlaps the portion of the seam 54 at the apex of the corner 20 and provides an extra layer of thickness at the seam, creating a secure base for the tab 70. In addition, the extra material on the outside of the corner 20 provides wear protection, adding additional life to the tent 22.

In accordance with another aspect of the present invention, an interior water seal panel may also be added to the corner 20. The interior water seal panel may be, for example, an additional fabric material stitched, heat or ultrasonically welded, glued, or otherwise attached into place against the interior of the corner 20. An example of an interior water seal panel, in the form of the sealing tape 28, is shown in FIG. 8. The sealing tape 28 may be, for example, a heat sealing tape that has an adhesive that is activated by heat and/or pressure. An example of a sealing tape 28 that may be used as an interior seal is a polyurethane tape, which may be attached by heat and pressure welding. This type of sealing tape works particularly well for nylon flooring. However, polyurethane tape is expensive, and cannot be used with inexpensive polyethylene floors, because it does not heat weld to that surface. In accordance with one aspect of the present invention, the present inventors have developed a method by which an interior water seal panel, e.g., a sealing tape 28, may be used with polyethylene.

To seal a corner 20 in which the sheet 26 is made of polyethylene (e.g., low density polyethylene sealed with polyurethane), the present invention utilizes a sealing tape also made of polyethylene, and heat welds that fabric into the interior of the corner. The heat welding process forms a solid connection between the sheet 26 and the sealing tape 28, effectively water-sealing the seam 54.

As can be seen in FIG. 8, the sealing tape 28 is bent to fit the contour of the interior of the corner 20. The flap 56 is bent to one side, and the sealing tape is pressed against the interior of the corner to hold the flap in position and to seal the seam 54. Once in place (FIG. 9), the sealing tape 28 may be sealed into position (for example, by welding as described above.

The sealing tape 28 adds an additional barrier against moisture, and also seals the flap, and thus the interior of the seam 54, against moisture penetration. This feature, along with the protective panel 24 and the inside-out inversion process used to construct the corner 20, creates a very stable and extremely moisture resistant seal for the corner. Although each of these features, used alone, adds moisture barrier benefits, any one of these features may be used alone to provide moisture barrier benefits, or any two may be used in combination. In addition, the teachings of the present invention may be applied to other locations where fabric is joined on a tent or other fabric structures. For example, two fabrics may be joined anywhere on a tent (e.g., along one edge) and may be inverted so that stitching that connects the two fabrics is on the inside of the tent. This stitching may be cover with the sealing tape in accordance with one aspect of the present invention.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A method of constructing a corner for a floor tub of a tent or canopy, comprising:

attaching two portions of a two layer fabric material so as to form a three-dimensional corner, the attachment of the two portions forming a seam, the two layer fabric material comprising a first layer of fabric material extending against a second layer of fabric material, the three-dimensional corner being configured so that the second layer of fabric material extends over an interior portion of the three-dimensional corner;

turning the three-dimensional corner inside out to form an inverted, three-dimensional corner wherein the second layer of fabric material extends over an exterior portion of the inverted, three-dimensional corner;

extending a second sheet of fabric material over the interior portion; and attaching walls of the tent or canopy to the floor tub.

2. The method of claim 1, wherein the two portions of the two layer fabric material are attached so that excess materials for the two portions at the seam extend adjacent to one another and on an exterior of the three-dimensional corner, and wherein turning the three-dimensional corner inside out comprises turning the excess materials toward an interior portion of the inverted, three-dimensional corner.

3. The method of claim 2, further comprising, arranging the excess materials to one side of the seam and wherein the second sheet of fabric material is extended over excess materials.

4. The method of claim 1, wherein the first and second portions of the two layer fabric material are attached by stitching.

5. The method of claim 1, wherein the first layer of fabric material includes a first notch formed therein, the first notch defining first side edges, and wherein the second layer of fabric material includes a second notch defining second side edges, and wherein the first side edges are aligned with the second side edges.

6. The method of claim 1, wherein the inverted three-dimensional corner comprises three sides, and wherein the second layer of fabric material extends over an exterior portion of each of the three sides of the inverted three-dimensional corner.

7. The method of claim 1, wherein the second sheet of fabric material comprises a sealing tape.

8. The method of claim 7, wherein the sealing tape comprises a waterproof sealing tape.

9. The method of claim 1, further comprising forming a tab on an apex of the inverted three-dimensional corner by pinching the apex of the inverted three-dimensional corner together and connecting the pinched apex to form the tab.

10. The method of claim 9, further comprising attaching a loop to the tab.

11. A tent having a floor tub with at least one corner formed in accordance with the method of claim 1.

12. The tent of claim 11, wherein each corner of the tub floor is formed in accordance with the method of claim 1.

13. A method of constructing a corner for a floor tub of a tent or canopy, comprising:

attaching two portions of a two layer fabric material so as to form a three-dimensional corner, the two layer fabric material having a notch cut therein, the notch defining two inner edges along which the two portions are attached, the attachment of the two portions forming a seam, the two layer fabric material comprising a first layer of fabric material extending against a second layer of fabric material, the three-dimensional corner being configured so that the second layer of fabric material extends over an interior portion of the three-dimensional corner;

turning the three-dimensional corner inside out to form an inverted, three-dimensional corner wherein the second layer of fabric material extends over an exterior portion of the three-dimensional corner;

sealing a second sheet of fabric material to an interior of the inverted, three-dimensional corner; and attaching walls of the tent or canopy to the floor tub.

14. The method of claim 13, wherein the second sheet of fabric material comprises a sealing tape.

15. The method of claim 14, wherein the sealing tape comprises a waterproof sealing tape.

16. The method of claim 13, wherein the sealing tape is welded to the interior.

17. The method of claim 13, further comprising forming a tab on an apex of the inverted three-dimensional corner by pinching the apex of the inverted three-dimensional corner together and connecting the pinched apex to form the tab.

18. The method of claim 17, further comprising attaching a loop to the tab.

19. A tent having a floor tub with at least one corner formed in accordance with the method of claim 13.

20. The tent of claim 19, wherein each corner of the tub floor is formed in accordance with the method of claim 13.

* * * * *